United States Patent [19]

Bosch et al.

[11] Patent Number: 4,577,592

[45] Date of Patent: Mar. 25, 1986

[54] SELF ADJUSTING CAMSHAFT GEAR FOR INTERNAL COMBUSTION ENGINES

[76] Inventors: Henery G. K. Bosch, 240-B S. Pecos, Denver, Colo. 80223; Thomas W. Pouliot, 2574 S. Yates, Denver, Colo. 80219

[21] Appl. No.: 625,242

[22] Filed: Jun. 27, 1984

[51] Int. Cl.[4] ..... F01L 1/34

[52] U.S. Cl. ..... 123/90.15; 464/3

[58] Field of Search ..... 123/90.15, 90.17, 420, 123/501; 464/3, 5, 6

[56] References Cited

U.S. PATENT DOCUMENTS

| | | | |
|---|---|---|---|
| 1,998,379 | 4/1935 | Mallory | 123/420 X |
| 3,314,408 | 4/1967 | Fenton | 123/90.17 X |
| 3,683,879 | 8/1972 | Timms | 123/501 |
| 3,728,870 | 4/1973 | Vuaille | 123/501 X |
| 3,958,543 | 5/1976 | Senda | 123/420 |
| 3,964,456 | 6/1976 | Eshelman | 123/420 |

FOREIGN PATENT DOCUMENTS

| | | | |
|---|---|---|---|
| 2454655 | 6/1975 | Fed. Rep. of Germany | 123/420 |
| 812303 | 4/1959 | United Kingdom | 123/90.17 |
| 884662 | 12/1961 | United Kingdom | 123/501 |

*Primary Examiner*—William R. Cline
*Assistant Examiner*—Peggy Neils
*Attorney, Agent, or Firm*—Linval B. Castle

[57] ABSTRACT

A self adjusting camshaft gear including an inner hub member and a coaxial outer gear-supporting member that is rotatably mounted to the periphery of the hub member. Weighted levers pivotally mounted to the side face of the outer gear member overlie a portion of the coplanar side face of the hub member and pivotally engage posts extending therefrom so that movement of the weighted levers around their gear member pivots will change the relative position of the hub with respect to the outer gear member and thereby advance or retard the camshaft. Springs between the levers and the hub member force the levers inward and into a normally advanced position for optimum power at low r.p.m. At some mid-range r.p.m. as determined by the spring modulus, the weighted levers are centrifugally forced outward to alter the rotational position of the hub with respect to the outer gear member to thereby retard the timing of the camshaft for optimum power at high r.p.m.

8 Claims, 3 Drawing Figures

SELF ADJUSTING CAMSHAFT GEAR FOR INTERNAL COMBUSTION ENGINES

BRIEF SUMMARY OF THE INVENTION

This invention relates generally to engine timing gears and in particular to a novel camshaft gear having means for automatically adjusting the angular position between the tooth periphery and keyed camshaft hub to retard the camshaft as engine r.p.m. increases.

To obtain the greatest effective power output of a conventional internal combustion engine, it is essential that the fuel intake and exhaust valves operate in precise timing with the engine pistons and crankshaft. The intake valves admitting the fuel/air mixture to the engine cylinders and the exhaust valves venting the burnt gasses are controlled by cams mounted on a camshaft rotated by a camshaft gear that may mech directly, or through a timing gear chain, to another gear keyed to the engine crankshaft. The camshaft and the crankshaft gears may thus be referred to as the engine timing gears.

The invention disclosed herein is for a camshaft gear that will automatically retard the angular position of the camshaft at some predetermined r.p.m. of the gear to thereby retain optimum output power at all engine speeds.

Briefly described, the self adjusting camshaft gear is comprised of an inner or camshaft hub portion that is bearing coupled for rotation with respect to a coaxial outer toothed portion. The gear has an internal chamber with coplanar and coaxial areas of both the inner and outer portions forming a floor normal to the axis or rotation of the gear. A plurality of weighted levers are pivotally coupled at one end to the outer portion floor and the opposite end of each lever is spring coupled to a post in the inner portion floor to thereby bias the levers toward the hub. Each lever is also coupled to a second post in the inner portion floor so that, at a certain r.p.m. determined by the spring constants, centrifugal force will overcome the spring bias to permit the levers to pivot outward and to thereby apply a force to each of the second floor posts that will rotate the shaft keyed hub portion of the gear with respect to its outer toothed portion to thereby retard the camshaft position with respect to the crankshaft. Thus, for example, if timing gears are initially adjusted to advance at perhaps six degrees for optimum low r.p.m. torque, the camshaft gear may begin its adjusting in the mid-range of about 3500 r.p.m. so that at approximately 4000 r.p.m., the adjustment corresponds to that of a stock camshaft. As r.p.m. increase, the camshaft gear further retards to provide optimum power at higher speeds. The camshaft of the invention therefore operates to broaden the range of the engine and provide an estimated overall engine power increase of about 10%.

BRIEF DESCRIPTION OF THE DRAWINGS

In the drawings which illustrate the preferred embodiment of the invention.

DETAILED DESCRIPTION

Figure 1:
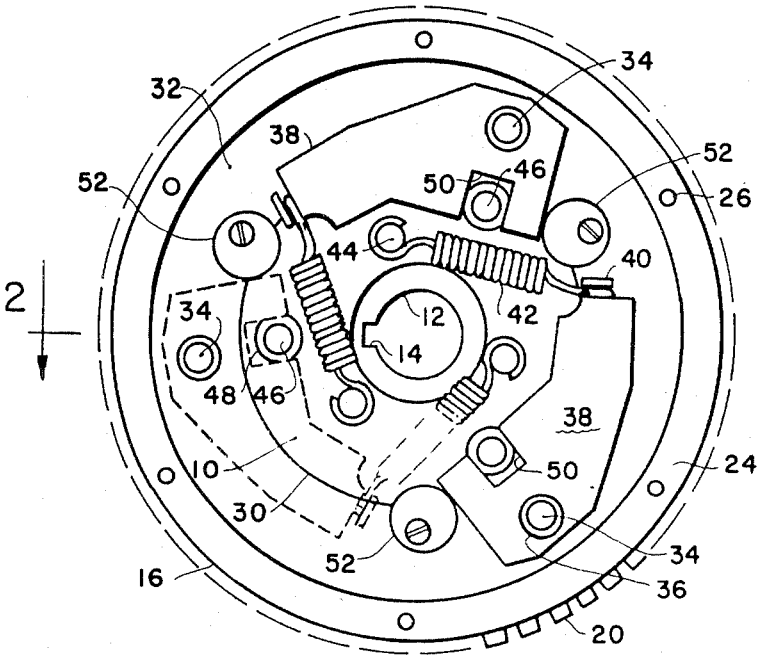
FIG. 1 is a plan view of the camshaft gear illustrating the inner chamber thereof and the position of the various components during low r.p.m. or stationary conditions.
Figure 2:
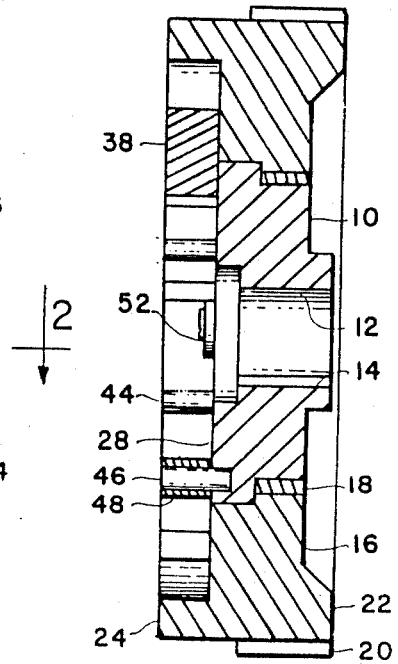
FIG. 2 is a sectional side view of the gear taken along the lines 2—2 of FIG. 1.

As illustrated in FIGS. 1 and 2, the camshaft gear is formed of two coaxial members. The inner member or hub 10 has an axial hole 12 with a suitable keyway 14 for securing an engine camshaft, and a circular outer surface that is coaxial with the camshaft hole 12. The outer member 16 is toroidal in shape with the circular inner surface rotatably mated to the circular outer surface of the hub 10 and separated therefrom by a lubricated metal bushing 18 so that the outer member 16 may freely rotate around the outer surface of the hub. Suitable gear teeth 20 for engaging corresponding teeth in a timing gear chain or on a crankshaft gear train are formed on the outside surface of the outer member 16. In the preferred embodiment, the root diameter of the outer member 16 is 5 inches, the total thickness of outer member at its periphery is 1.5 inches, and the width of the teeth 20 is 0.75 inches, but it is to be understood that many other different dimensions may be employed.

As best illustrated in FIG. 2, the gear teeth 20 are formed in the peripheral surface of the outer member 16 and against a first side surface 22 of the member. The opposite side surface of both the hub member 10 and outer member 16 contains a circular recessed area approximately 0.5 inches in depth and about 4.5 inches in diameter, thereby leaving a rim 24 which, as shown in FIG. 1, contains a plurality of tapped holes 26 for securing a circular cover plate (not shown) over the recessed area to prevent the entry of dirt and abrasive contaminants into the area during use. As shown in FIG. 2, the recessed area has a flat inner floor 28 formed in both the hub member 10 and its coaxial outer member 16. At this point in the description the outer member 16 may freely rotate around the periphery of the hub 10, the separation between hub and outer member being shown in FIGS. 1 and 3 by the line 30.

Figure 3:
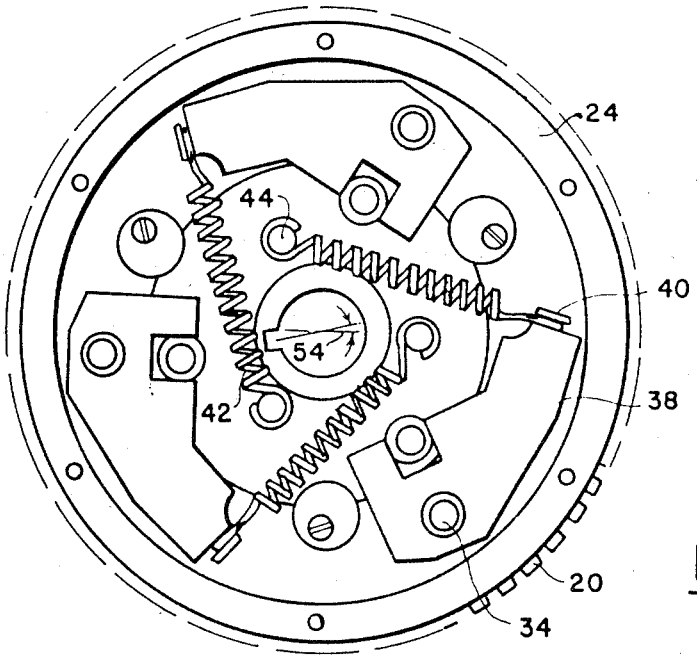
FIG. 3 is a plan view of the gear illustrating the inner chamber and the position of the components at speeds above a predetermined r.p.m.

Vertically mounted near the center of the recessed floor 32 of the toroidal outer member 16 are a plurality of equally spaced posts 34, three being employed in the illustrated preferred embodiment. Tubular lubricated bushings 36 are mounted on the posts and a weighted centrifugal lever 38 is pivotally mounted to each of the bushings. Therefore, each of the levers 38 may freely rotate within limits about its respective post 34. Each of the several centrifugal levers are identical in weight and size and, as illustrated in FIG. 3, each has an outer configuration that roughly conforms to inside surface of the outer member rim 24. The length of each lever 38 is approximately two inches and at the end opposite the post 34 is a short shaft with a rivet type head 40 suitable for attaching the loop at the first end of an extension spring 42.

The second end of each extension spring 42 is looped over a post 44 extending from and perpendicular to the floor of the hub 10. Each post 44 is positioned in the hub floor so that the angle formed between pivot pin 34, head 40, and pin 44 is substantially a right angle, the distance between head 40 and pin 44 depending upon the spring length and characteristics.

A plurality of second posts 46 extend from the floor of the hub 10 near the separation line 30 between hub 10 and outer member 16. A lubricated metal tubular bushing 48 is mounted on each of these second posts 46 and each bushing 48 has, on its outer surface, a pair of parallel flats that engage a rectangular opening 50 in the inner surface that extends over the hub floor of each of the plurality of centrifugal weights 38. In the preferred embodiment, the second posts 46 lie on a circle approximately 0.75 inches within the circle upon which the pivot posts 34 are located, and substantially upon the same radial as shown in FIG. 1. Because the tubular bushings 48 contain exterior flats, they are free to rotate about their respective posts 46 and may also slide within the rectangular openings 50 of the centrifugal weights 38, thereby offering no restriction to the pivotal movement of the weights 38.

A low r.p.m. manual adjustment of the gear is provided by stop discs 52 which are screwed to the outer member floor 32 through offset screw holes in the discs. As shown in FIG. 1, each disc 52 is attached to the floor 32 near the member separation line 30 and the end of each weight 38 opposite the spring attachment head 40. The stop discs 52 also serve to lock together the hub 10 and outer member 16. As illustrated in FIG. 2, a small step in both the hub and outer member prevent the separation of the members in only one direction; as shown, the hub cannot be removed from the right side of FIG. 2 over the bushing 18. The stop discs 52 shown in FIGS. 1 and 3 overlie the member separation line 30 and therefore prevent removal of the hub 10 from the left side of FIG. 2.

OPERATION

At rest or at low r.p.m. the centrifugal weights 38 within the gear are shown in FIG. 1. The springs 42 are compressed and have drawn in the head ends of the weights toward the rotational axis of the gear so that the opposite end of the weights are against the manually adjustable stop discs 52. In this position, the lever arm formed between the pivot post 34 and the posts 46 in the hub floor has forced the hub into its most clockwise position with respect to the outer member.

At some predetermined higher r.p.m. (e.g. 3500 engine r.p.m or 1750 camshaft gear r.p.m.), the centrifugal forces of the weights 38 overcome the compressing forces of the extension springs 42 and the weights begin to pivot clockwise on the posts 34 as shown in FIG. 3. This clockwise pivoting of the weights 38 produce a lever force on the posts 46 in the hub floor, causing the entire hub 10 to rotate counter-clockwise with respect to the outer member. Thus the camshaft keyway 14 is rotated as indicated in FIG. 3 by the angle 54 which in turn retards the rotation of the cams attached to the camshaft and thus the operation of the valves in the engine thereby to assure maximum output power of the engine at higher as well as at lower r.p.m. As engine r.p.m. is thereafter reduced, the centrifugal forces of the weights fall below the spring forces and the weights are again drawn in as shown in FIG. 1 to advance the camshaft and provide higher torque and optimum power at low speed.

We claim:

1. A camshaft gear for an internal combustion engine, said gear comprising:

a hub member having an axial bore for receiving a camshaft and having a circular periphery coaxial with said camshaft bore;

a toroidal gear member coaxial with said hub member bore and having an inner surface in slideable contact with the periphery of said hub member, the periphery of said gear member being circular and having timing gear teeth thereon;

a plurality of at least three centrifugal weights coupled to a side face of said gear member for pivotal movement in a plane parallel with said side face, each of said plurality being slideably coupled to a first post extending from a corresponding side face of said hub member for rotating said hub member with respect to said gear member upon pivotal movement of said plurality of weights;

stop means including a plurality of discs, each disc adjustably connected by a screw through an off-center hole in said disc to said side face of said gear member and at a location overlying a portion of said hub member and adjacent the pivotal end of one of said weights for locking said hub against removal from said gear member and for adjusting the position of said weights when said camshaft is stationary; and resilient means coupled between said hub member and each of said plurality of weights for preventing said pivotal movement of said plurality of weights below a predetermined rotational velocity of said camshaft.

2. The camshaft gear claimed in claim 1 wherein the side faces of said hub member and said gear member are coplanar and normal to the axis of said axial bore through said hub member.

3. The camshaft gear claimed in claim 2 wherein each of said plurality of centrifugal weights are elongated in shape and are pivotally mounted at a first end through a bearing to a pivot post extending from said side face of said gear member, the second end of each of said plurality being coupled to said resilient means.

4. The camshaft gear claimed in claim 3 wherein said resilient means is an extension spring coupled between the second end of each of plurality of weights and second posts extending from the side face of said hub member, said spring extending substantially at right angles from the elongated axis of its respective centrifugal weight.

5. The camshaft gear claimed in claim 4 wherein each of said first posts are substantially on a line between the center of said axial camshaft bore and the pivot posts extending from the side face of said gear member, and wherein each of said plurality of centrifugal weights have a width that extends over a portion of the side face of said hub member to engage a respective first post through a tubular bushing.

6. The camshaft gear claimed in claim 5 wherein said tubular bushings have a tubular bore for engaging said first posts and a circular peripheral surface with parallel flat surfaces on opposite sides of said peripheral surfaces for slideably engaging flat side surfaces of a slot in the extended side surface of a weight.

7. The camshaft gear claimed in claim 6 further including means for attaching a cover plate for covering and protecting said side faces of said gear member and said hub member.

8. The camshaft gear claimed in FIG. 7 wherein the side faces of said gear member and of said hub member are recessed in the body of said camshaft gear, and wherein said cover plate may be secured to a rim on said gear member surrounding said recess in said body.

* * * * *